US006357419B1

(12) United States Patent
Langer et al.

(10) Patent No.: US 6,357,419 B1
(45) Date of Patent: Mar. 19, 2002

(54) METHOD AND DEVICE FOR OPERATING AND MONITORING AN INTERNAL COMBUSTION ENGINE

(75) Inventors: Winfried Langer, Markgroeningen; Frank Bederna, Crespellano; Martin Streib, Vaihingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/554,128

(22) PCT Filed: May 28, 1999

(86) PCT No.: PCT/DE99/01579

§ 371 Date: May 9, 2000

§ 102(e) Date: May 9, 2000

(87) PCT Pub. No.: WO00/14394

PCT Pub. Date: Mar. 16, 2000

(30) Foreign Application Priority Data

Sep. 9, 1998 (DE) ..... 198 41 151

(51) Int. Cl.[7] ..... F02D 43/04

(52) U.S. Cl. ..... 123/443; 123/479; 123/480; 123/690

(58) Field of Search ..... 123/333, 361, 123/399, 350, 478, 480, 486, 295, 344, 690, 443, 479

(56) References Cited

U.S. PATENT DOCUMENTS 4,671,238 A 6/1987 Ohtaki et al. ..... 123/438
4,869,224 A * 9/1989 Ishikawa et al. ..... 123/489
5,080,064 A * 1/1992 Buslepp et al. ..... 123/399
5,284,116 A * 2/1994 Richeson, Jr. ..... 123/480
5,692,472 A 12/1997 Bederna et al. ..... 123/350
5,970,947 A * 10/1999 Iida et al. ..... 123/295
6,055,476 A * 4/2000 Yoshino ..... 701/110
6,085,717 A * 7/2000 Kamura et al. ..... 123/295

FOREIGN PATENT DOCUMENTS

| | | |
|---|---|---|
| DE | 42 23 520 | 1/1994 |
| FR | 2 657 398 | 7/1991 |
| FR | 2 722 248 | 1/1996 |

* cited by examiner

*Primary Examiner*—Henry C. Yuen
*Assistant Examiner*—Hieu T. Vo
(74) *Attorney, Agent, or Firm*—Walter Ottesen

(57) ABSTRACT

A method and an arrangement for operating and monitoring an internal combustion engine are suggested wherein, in at least one operating state, operation is undertaken with a lean air/fuel ratio. At least one quantity, which represents the degree of actuation of the accelerator pedal, and a quantity, which represents the engine rpm, are detected and, in at least one operating state, only an operation of the engine with an approximately stoichiometric or rich mixture is permitted and/or only an operation with limited air supply is permitted. The operation is monitored on the basis of at least one operating variable of the engine.

8 Claims, 3 Drawing Sheets

METHOD AND DEVICE FOR OPERATING AND MONITORING AN INTERNAL COMBUSTION ENGINE

FIELD OF THE INVENTION

The invention relates to a method and an arrangement for operating and monitoring an internal combustion engine.

BACKGROUND OF THE INVENTION

The monitoring of the control of a conventional internal combustion engine on a torque basis is shown in DE-A 195 36 038 (U.S. Pat. No. 5,692,472). There, a maximum permissible torque or a maximum permissible power is determined at least on the basis of the accelerator pedal position. Further, the actual torque or the actual power of the internal combustion engine is computed in dependence upon the engine rpm, ignition angle position and load (air mass, et cetera). For monitoring, the maximum permissible value is compared to the computed actual value. Measures for fault reaction are initiated when the actual value exceeds the maximum permissible value. The measures for fault reaction comprise reducing power, for example, by cutting off the metering of fuel to the engine until the actual value again drops below the maximum permissible value.

This monitoring strategy affords a reliable and satisfactory monitoring of the control of the engine in the entire operating range. It is based, however, on the measured air mass supplied to the engine. For internal combustion engines, which are operated at least in one operating state with a lean air/fuel mixture, the torque, which is determined from the measured air mass, or the determined power does not correspond to the actual values so that the described monitoring can be utilized only to a limited extent.

This is so primarily for internal combustion engines having direct injection because, in stratified operation, the detected air mass and the adjusted ignition angle are not sufficient for computing the actual torque. The injected fuel mass, which cannot be measured, here has, as with all lean-operated engines, a great effect on the torque which cannot be considered by the procedure in the state of the art. However, especially the fuel mass can be too high because of the influence of defects such as a rail pressure which is too high or an injection valve which closes too slowly so that a torque, which is too high, can occur and therefore unwanted operating states of the engine can result.

SUMMARY OF THE INVENTION

It is an object of the invention to provide measures for monitoring the control of an internal combustion engine which is operated at least in some operating states with a lean air/fuel mixture.

A procedure for controlling a direct-injection gasoline internal combustion engine is disclosed in U.S. Pat. No. 6,092,507. This engine is essentially controlled in two different modes of operation, the stratified operation and the homogeneous operation. In homogeneous operation, fuel is injected during the induction phase and the engine is throttled. In stratified operation, the injection is during the compression phase and the engine is operated without throttling.

In the homogeneous operation, a desired torque value is determined from at least the position of the accelerator pedal. This desired torque value is converted into a fuel mass to be injected. Furthermore, and proceeding from this fuel mass, a desired throttle flap angle for adjusting the air supply to the engine is determined in the sense of an adjustment of a pregiven desired value for the composition of exhaust gas. The latter does not apply to the stratified operation wherein the engine is unthrottled, that is, is operated with an open throttle flap. The homogeneous operation takes place at least in the region of higher loads; whereas, the stratified operation takes place in the region of lower loads or in the part-load region. Measures for monitoring functions of the control system are not described in the above-mentioned publication.

The solution in accordance with the invention permits an effective and adequate monitoring of the control of an internal combustion engine which is operated at least in some operating states with a lean air/fuel mixture.

Special advantages are shown with the monitoring of the function of the control of internal combustion engines having gasoline-direct injection.

It is especially advantageous that, when the engine is operated with a lean mixture in dependence upon the accelerator pedal position, a maximum permissible torque is derived above which the air supply to the engine is limited. This takes place preferably by closing the throttle flap.

It is of special advantage that only for a released accelerator pedal (that is, with the pedal position in idle), a maximum rpm is pregiven above which the air supply is limited. In this way, at least an especially critical operating state is covered by a precise and reliable fault detection so that no unwanted operating situation can develop in this operating state.

In this way, it is ensured that for switched off fuel (for example, because of a leaking injection valve), an ignitable mixture is still provided and the torque or the power is not impermissibly high. In an advantageous manner, the fresh air supply is so adjusted that, if an injection would take place, a torque would result for a stoichiometric mixture composition which leads to no impermissible vehicle reaction.

Of special advantage is, as a supplement or in the alternative to the above solution, the switchover to stoichiometric or rich operation. Then access can be made to the monitoring method known from the state of the art. In an advantageous manner, this is carried out when the accelerator pedal is released. Here too, it is advantageous when the supplied fresh air quantity is so adjusted by control of the throttle flap in dependence upon the driver input and the rpm so that an idle torque results. If the instantaneously computed torque or the instantaneously computed power exceeds, then this fault is detected and countermeasures are initiated.

In an especially advantageous manner, the maximum rpm is applied for monitoring with the pedal released and the fresh air quantity is limited. Either the metering of fuel is switched off or, in special operating states, the stoichiometric operation is initiated. The operating states are those wherein, for example, a switchoff above the rpm cannot take place because of a hot catalytic converter or for reasons of comfort, for example, in first gear. In both cases, access is made to the known monitoring method based on the determined air supply.

BRIEF DESCRIPTION OF THE DRAWINGS

The invention will now be described with reference to the drawings.

DESCRIPTION OF THE PREFERRED EMBODIMENT OF THE INVENTION

Figure 1:
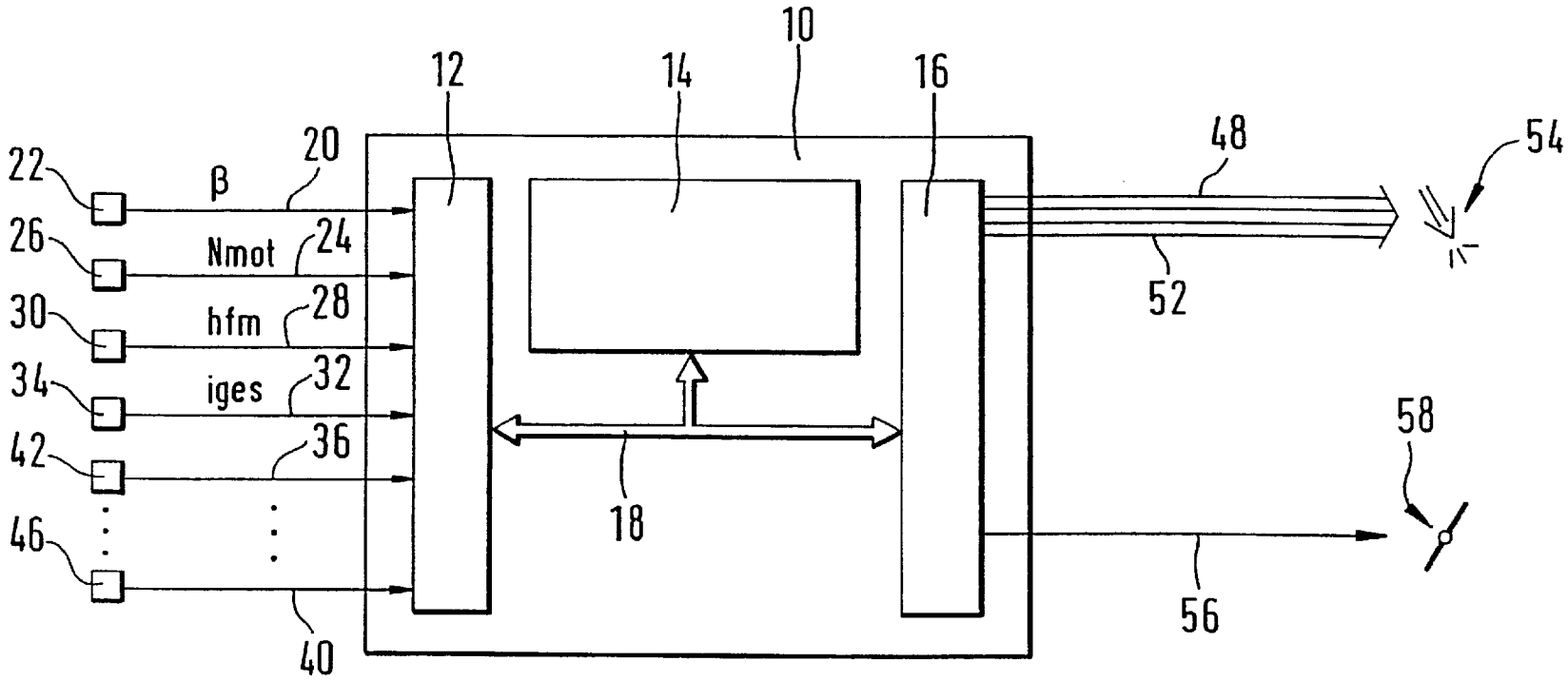
FIG. 1 is a block diagram showing a control arrangement according to the invention.

In FIG. 1, a control unit 10 is shown which includes as elements at least an input circuit 12, at least one microcomputer 14, an output circuit 16 and a communication system 18 connecting these elements. Input leads are connected to the input circuit 12 via which signals from corresponding measuring devices are supplied. The signals represent operating quantities or operating quantities are derivable therefrom. With respect to the solution according to the invention described hereinafter, an input line 20 is shown in FIG. 1 which connects the control unit to a measuring device 22 which detects a quantity representing the degree β of actuation of the accelerator pedal. Furthermore, an input line 24 is provided which originates from a measuring device 26 and via which a quantity is supplied representing the engine rpm NMOT. In addition, an input line 28 connects the control unit 10 to a measuring device 30 which outputs a signal representing the supplied air mass HFM. An input line 32 supplies a quantity from a measuring device 34 which corresponds to the actual ratio IGES in the drive train. Furthermore, input lines 36 to 40 are provided which bring in signals representing operating quantities from measuring devices 42 to 46. For example, such operating quantities which can be applied in the control of the engine are: temperature quantities, the position of the throttle flap angle et cetera. In the embodiment shown in FIG. 1, output lines 48 to 52 lead from the output circuit 16 for controlling the injection valve 54 as well as an output line 56 for controlling the electromotorically adjustable throttle flap 58. In addition, at least lines (not shown) for controlling the ignition are provided.

The fuel metering and the air supply are controlled in accordance with a predetermined air/fuel ratio on the basis of the degree β of actuation of the accelerator pedal. The air/fuel ratio can be lean or, depending on the operating situation, can change between a rich setting, an almost stoichiometric setting or a lean setting.

For the control of engines with gasoline-direct injection in accordance with the state of the art initially mentioned herein, a torque desired value is formed on the basis of the degree β of actuation which is converted into a value for the fuel mass to be injected. The conversion takes place, for example, while considering the engine rpm and the particular actual mode of operation. The switchover between homogeneous operation and stratified operation takes place, for example, in dependence upon the load condition of the engine. Accordingly, the engine is operated, for example, at higher load in homogeneous operation, at lower load and also in idle and in part load in the stratified operation. In homogeneous operation, a desired throttle flap angle is computed in dependence upon the computed fuel mass while considering the actual operating state of the engine. The electromotorically adjustable throttle flap and therefore the air supply to the engine is adjusted in dependence upon this desired throttle flap angle. Here, a pregiven desired value for the air/fuel ratio is considered. In stratified operation, the engine operates unthrottled, that is, the engine operates with a lean mixture composition. An adjustment of the throttle flap does not take place. Switchover strategies between the two operating states are, for example, known from the state of the art mentioned initially herein.

Depending upon the embodiment, the control unit described in FIG. 1 serves for the control of an intake manifold injection engine which is operated lean or for controlling an engine having gasoline-direct injection.

In the lean operation, the adequate functional operability of the comparisons initially mentioned herein is not ensured for monitoring the function of the control of the engine. However, in order to also make a satisfactory monitoring of the control function available to these control concepts, at least in a specific operating state, only an operation is permitted with stoichiometric or almost stoichiometric or with a rich air/fuel ratio or with a limited fresh air supply. In this way, the initially mentioned torque monitoring or power monitoring can be carried out in a satisfactory manner in this operating state.

The at least one operating state is an operating state wherein the accelerator pedal is almost released, especially wherein its position drops below a pregiven threshold value and the engine rpm exceeds a limit value. Then only at least one of the above-described modes of operation is permitted. If deviations are recognized, for example, because of the torque monitoring, then fault measures are initiated. If the rpm is below the limit value and/or the accelerator pedal position is above the threshold value, then the operation with a lean air/fuel ratio is permitted. A monitoring via a torque comparison does not take place.

If the engine rpm is above a threshold value (for example, 1500 rpm) in the specific operating state, then the fuel metering is switched off (overrun cutoff). At the same time, and for operation with limited fresh air supply, the throttle flap and therefore the fresh air supply is so adjusted that an engine torque in the region of idle torque would result if, in lieu of the overrun cutoff (for example, as a consequence of a defective state), a fuel quantity or fuel mass would be injected which is stoichiometric to the fresh air quantity or fresh air mass. For example, the throttle flap position is adjusted via a corresponding rpm-dependent characteristic line.

This applies also when the engine is operated with a stoichiometric or almost stoichiometric air/fuel ratio or with a rich air/fuel ratio. This is primarily the case when the overrun cutoff is not permitted, for example, because of exhaust gas reasons; that is, fuel is injected. Here too, the fresh air quantity or fresh air mass and therefore the fuel quantity or fuel mass is so limited that a torque value results which lies in the region of the idle torque. If the rpm is below the threshold value, then the idle controller takes over the torque control.

The known torque comparison or power comparison takes place on the basis of a comparison value during the operation with stoichiometric or almost stoichiometric or with a rich air/fuel ratio or with a limited fresh air supply. The comparison value is computed from a measured signal representing the fresh air quantity or the fresh air mass. If the comparison value exceeds the maximum permissible value, the current supply for the electrically controlled throttle flap is switched off and/or the fuel metering is interrupted.

If the internal combustion engine is operated with gasoline-direct injection, a check is made in a first embodiment during stratified operation for fault detection whether the accelerator pedal is in the idle position, that is, whether the accelerator pedal is completely released. In this operating state, a maximum engine rpm (for example, 1500 rpm) is pregiven. If the actual rpm exceeds this maximum rpm, then the fuel metering to the engine is switched off until the engine rpm again drops below the maximum rpm. An increased rail pressure can therefore not be negatively effective and unwanted operating situations are effectively avoided in this operating phase. In a supplemental embodiment, a maximum rpm is pregiven not only in the operating state "idle", that is, when the accelerator pedal is released; instead, the maximum rpm is pregiven in the entire accelerator pedal position range. A characteristic line is stored wherein the maximum rpm is read out in dependence upon the degree of actuation of the accelerator pedal. If the actual rpm exceeds the maximum rpm, which is dependent upon the degree of actuation, the fuel metering is cut off as shown above.

Alternatively, a switchover to stoichiometric operation ($\lambda$=1) is made at least in one operating state for stratified operation at least when the accelerator pedal is in the idle position. In this operating state, the torque comparison is carried out which is known from the state of the art mentioned initially herein. The fuel mass need not be considered so that possible fault conditions are detected and unwanted operating situations in this operating state are effectively avoided. In lieu of a torque monitoring, a corresponding monitoring of the power of the engine is carried out.

In addition, these two measures can be combined. For stratified operation, the maximum rpm comparison is first carried out. In operating states wherein a fuel cutoff above the pregiven engine rpm is not carried out (for example, in operating states wherein the engine rpm must be exceeded because of a hot catalytic converter) or is not carried out for reasons of comfort, such as in the first gear, there is a switchover to $\lambda$=1 operation. In these special operating situations, the above-mentioned torque or power comparison is used for fault monitoring.

The result therefore is an adequate monitoring of an engine with gasoline direct injection. The torque monitoring or power monitoring known from the state of the art is carried out in homogeneous operation.

Figure 2:
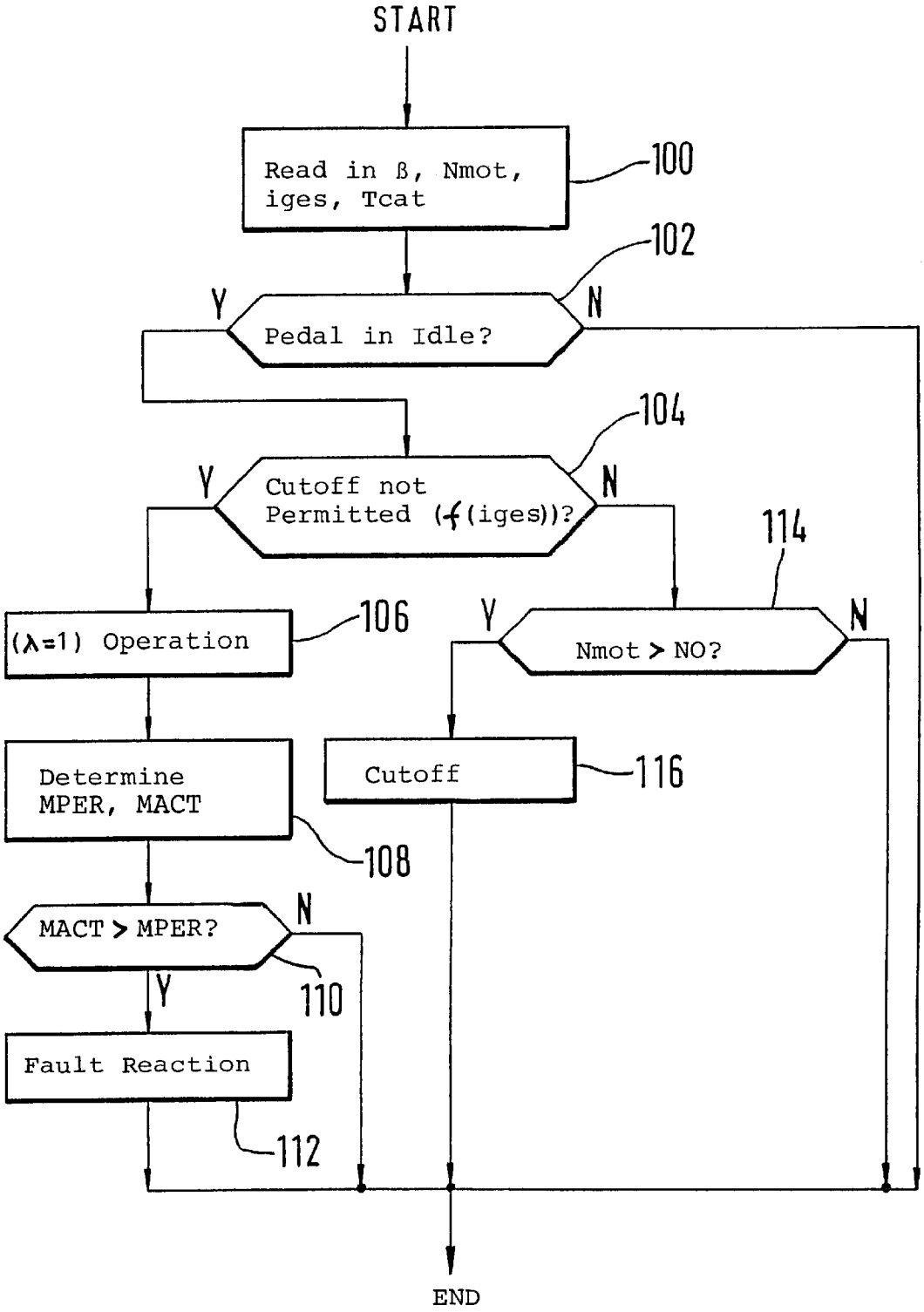
FIG. 2 shows an embodiment of the invention as a flowchart for the preferred embodiment of an internal combustion engine having gasoline direct injection.

A preferred embodiment for an internal combustion engine with gasoline direct injection is sketched as a computer program with reference to the flowchart in FIG. 2. A corresponding program results with the use of the described solution with intake manifold injectors.

The program is started at pregiven time intervals. In the first step 100, the needed operating variables are read in, for example: the degree $\beta$ of actuation, engine rpm NMOT, transmission ratio IGES and, if required, the temperature TCAT of the catalytic converter. In the next step 102, a check is made as to whether the accelerator pedal is in the idle position LL via a comparison of the degree of actuation with a limit value. If this is not the case, the program is ended and is initiated at the next time point.

If this is the case, then, in accordance with step 104, a check is made as to whether a fuel cutoff above the maximum rpm, which is pregiven for the idle position of the accelerator pedal, would not be carried out. This is determined, for example, based on the transmission ratio and/or on the temperature of the catalytic converter. If the temperature of the catalytic converter is high and/or the transmission ratio indicates that a first gear has been engaged, then the cutoff is not carried out. In this case, and in accordance with step 106, a switchover to stoichiometric operation ($\lambda$=1 operation) takes place or the already initiated stoichiometric operation is continued. Further, at least for an engine rpm above the idle range, the fresh air supply is limited in that the throttle flap is correspondingly controlled. In this way, an adjustment of the throttle flap and therefore of the fresh air supply is ensured which leads to an idle torque. If this cannot take place in a defective manner or if the stoichiometric operation was not initiated or not completely initiated, then a fault is recognized as described hereinafter. In lieu of an almost stoichiometric adjustment, a rich adjustment of the mixture can take place. Thereupon, in step 108, the permissible torque MPER is determined, as known, on the basis of the degree of actuation of the accelerator pedal as well as on the basis of additional operating quantities, as required, and the current actual torque MACT is determined on the basis of the air mass and additional operating variables. In the next step 110, the actual torque is compared to the maximum permissible torque. If the actual torque exceeds the maximum permissible torque, then in step 112, a fault reaction is initiated, for example, the fuel metering is switched off and/or the current is switched off to the electrically controllable throttle flap. The throttle flap is then returned to its rest position via a return device. If the actual torque does not exceed the maximum permissible torque, then the program is ended in the same way as after step 112 and is carried out anew at the next time point.

If it results in step 104 that the cutoff of the fuel metering would be carried out above the limit rpm, then, in step 114, the actual engine rpm NMOT is compared to the pregiven limit value N0. If the engine rpm exceeds this limit value, then, in accordance with step 116, the fuel metering is switched off. Furthermore, the fresh air supply is limited as described above. Thereafter, the program is ended as in the case of a negative answer in step 104 or is continued with step 110.

In another embodiment, in step 106, $\lambda$=1 operation is not carried out; instead, an operation is carried out with another pregiven $\lambda$ value. The deviation of the $\lambda$ value from 1 is considered in the computation of the actual torque.

In the homogeneous operation wherein the fuel mass is injected during the induction phase, the operation is checked, as known, in the context of the torque comparison or power comparison so that the program shown in FIG. 2 is carried out only for operation in the stratified mode, that is, for injection during the compression phase.

The embodiment shown in FIG. 2 is made clear in FIG. 3 based on an exemplary operating situation with the aid of time diagrams. FIG. 3*a* shows the trace of the degree $\beta$ of actuation as a function of time. FIG. 3*b* shows the trace of the engine rpm NMOT or the trace of the limit value NO of the engine rpm. FIG. 3*c* shows the trace of the maximum permissible torque MPER as well as the actual torque MACT. In FIG. 3*d*, the operating state of the switchoff of the metering of fuel is shown based on a two-value signal as a function of time.

First, the accelerator pedal is actuated. Up to time point T0 (see FIG. 3*a*), the driver releases the pedal so that the accelerator pedal is in the idle position starting at time point T0 for the remaining time of the operating state shown.

Figure 3A:
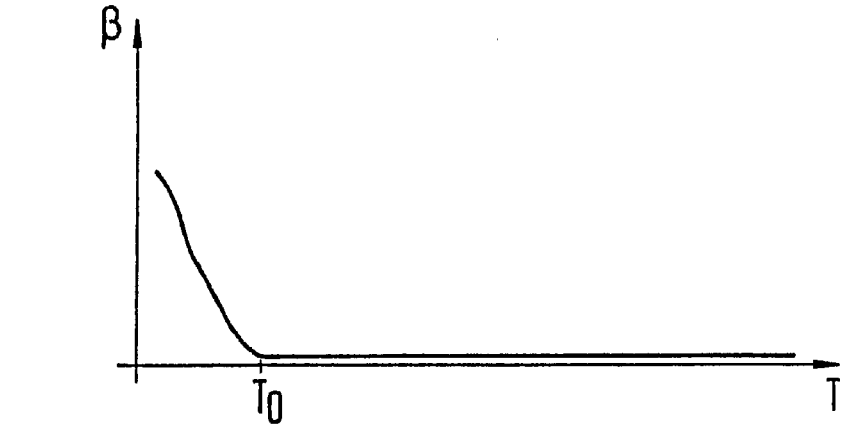
FIG. 3*a* is a trace of the degree β of actuation of the accelerator pedal as a function of time.
Figure 3B:
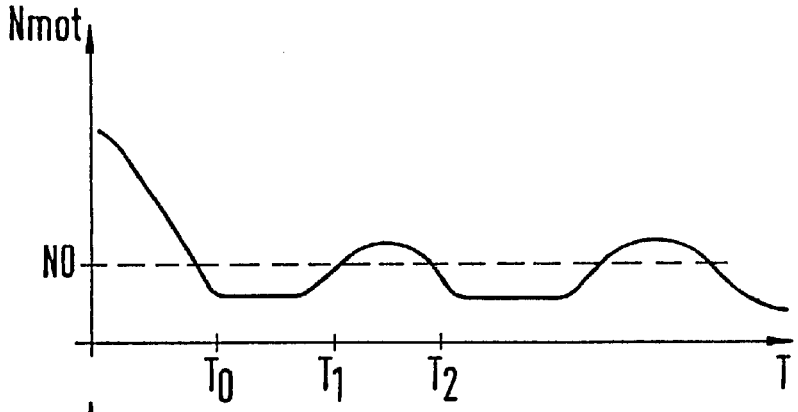
FIG. 3*b* is a trace of engine speed as a function of time.
Figure 3C:
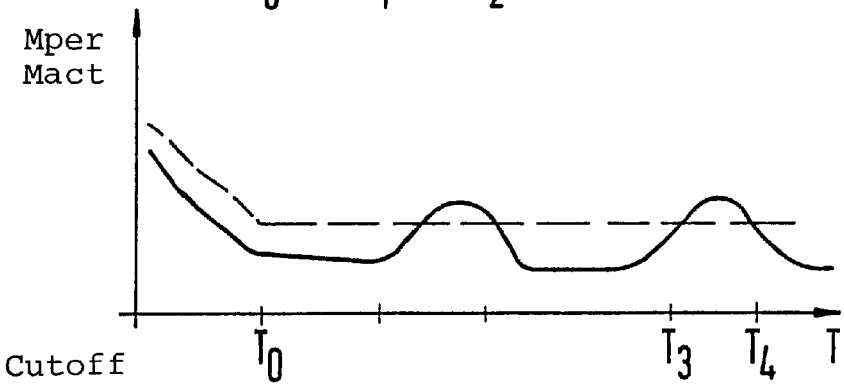
FIG. 3*c* is a trace of the maximum permissible torque and the actual torque both as a function of time; and, FIG. 3*d* shows the operating state of the cutoff of the metering of fuel as a function of time.
Figure 3D:
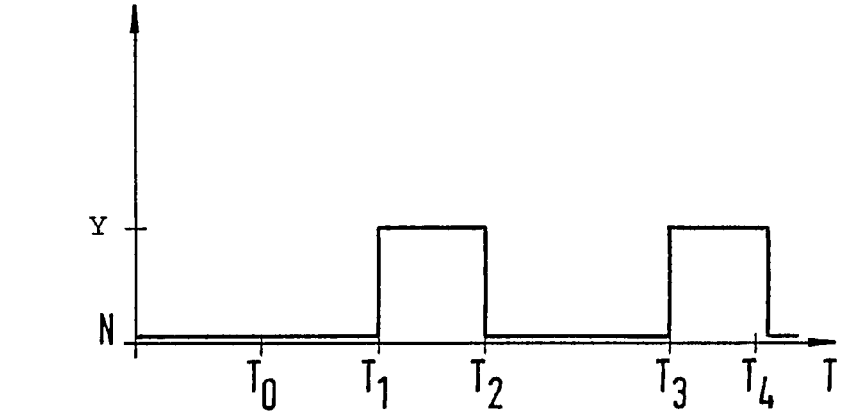

The engine is operated in the stratified mode. In FIG. 3*b*, it is shown how the engine rpm NMOT (solid line) changes in correspondence to the driver input (see FIG. 3*a*). The idle rpm is reached at time point T0. The limit rpm NO is pregiven (broken line). At time point T1, the engine rpm exceeds the limit value (see FIG. 3*b*) and, at time T2, there is again a drop below the limit value. For this reason, the fuel metering is switched off between the time points T1 and T2 in accordance with FIG. 3*d*. In FIG. 3*c*, the trace of the maximum permissible torque (broken line) and the current actual torque (solid line) are shown. Ahead of time point T0, the actual torque and the maximum permissible torque run essentially corresponding to the driver input i. Starting at time point T0, the maximum permissible torque for the idle condition is pregiven. At time points T1 and T2, the check is made on the basis of the engine rpm trace. After time point T2, a switchover to stoichiometric operation takes place. This means that, in this case, the monitoring takes place on the basis of the torque signals. If the actual torque exceeds the maximum permissible torque at time point T3 and if the actual torque drops below this torque at time point T4, then the fuel metering is switched off between the time points T3 and T4 (see FIG. 3*d*). For the purposes of clarification, the trace of the engine rpm and the trace of the actual torque are shown clearly separate from one another. In the second operating phase, a crossover of the limit value by the engine rpm does not lead to a cutoff of the fuel; instead, only exceeding the maximum permissible torque by the actual torque at time point T3 leads to a fuel switchoff.

What is claimed is:

1. An arrangement for operating and monitoring an internal combustion engine which, in at least one operating state, is operated with a lean air/fuel ratio, the arrangement comprising:

means for detecting at least a first quantity (β) representing the degree of actuation of the accelerator pedal and a second quantity representing the engine rpm (Nmot);

a control apparatus including: means for operating the engine at least in dependence upon said first quantity (β) with a lean air/fuel ratio;

means for switching over the operation of said engine to at least one of the following modes of operation when said engine is in an operating state having a lean air/fuel ratio:

(a) an operation with an approximately stoichiometric air/fuel ratio;

(b) an operation with a rich air/fuel ratio; and, (c) an operation with limited air supply;

means for determining a maximum permissible value of an operating variable of said engine at least in dependence upon said first quantity (β);

means for detecting an actual value of said operating variable; and, means for initiating a fault reaction measure when said actual value exceeds said maximum permissible value.

2. A method for operating and monitoring an internal combustion engine, which is operated in at least one operating state with a lean air/fuel ratio, the method comprising the steps of:

detecting at least a first quantity (β) representing the degree of actuation of the accelerator pedal and a second quantity (Nmot) representing the engine rpm;

operating the engine at least in dependence upon said first quantity (β) with a lean air/fuel ratio;

when said engine is in an operating state having a lean air/fuel ratio, switching over the operation of said engine to at least one of the following modes of operation:

(a) an operation with an approximately stoichiometric air/fuel ratio;

(b) an operation with a rich air/fuel ratio; and, (c) an operation with limited air supply;

determining a maximum permissible value of an operating variable of said engine at least in dependence upon said first quantity (β);

detecting an actual value of said operating variable; and, initiating a fault reaction measure when said actual value exceeds said maximum permissible value.

3. The method of claim 2, wherein, for operation with an almost stoichiometric or rich air/fuel ratio, the air supply is so adjusted that a torque or a power results in the region of the idle value.

4. The method of claim 2, wherein, for operation with limited air supply and switched off fuel metering, the air supply is adjusted in such a manner that an engine torque or engine power would result in the region of idle when a quantity of fuel would be injected approximately stoichiometric to the air supply.

5. The method of claim 2, wherein: the at least one operating state is determined in dependence upon the degree of actuation of the accelerator pedal and the engine rpm and is especially then present when, for a degree of actuation of the accelerator pedal below a pregiven value, preferably close to idle position, an engine rpm above a pregiven threshold value is present.

6. The method of claim 2, wherein, in the at least one operating state, a maximum permissible torque or a maximum permissible power is computed and this value is compared to a comparison value and a fault is recognized when the comparison value exceeds the permissible value.

7. The method of claim 6, wherein: the comparison value is computed from at least a signal representing the current air supply.

8. The method of claim 2, wherein, for a recognized fault, the current supply to an electrically actuated throttle flap is interrupted and/or the fuel metering is interrupted.

* * * * *